US005853819A

United States Patent [19]

Lelental et al.

[11] Patent Number: 5,853,819

[45] Date of Patent: Dec. 29, 1998

[54] IMAGING ELEMENT COMPRISING AN ELECTRICALLY CONDUCTIVE LAYER FORMED BY A GLOW DISCHARGE PROCESS

[75] Inventors: Mark Lelental, Rochester; Bradley Keith Coltrain, Fairport; David Appler Glocker, West Henrietta; Dennis R. Freeman, Spencerport; Jeremy Matthew Grace, Rochester, all of N.Y.

[73] Assignee: Eastman Kodak Company, Rochester, N.Y.

[21] Appl. No.: 738,948

[22] Filed: Oct. 24, 1996

Related U.S. Application Data

[60] Continuation of Ser. No. 439,199, May 11, 1995, abandoned, which is a division of Ser. No. 297,993, Aug. 30, 1994, abandoned.

[51] Int. Cl.[6] ..... B05D 3/06; G03C 1/85

[52] U.S. Cl. ..... 427/537; 427/539; 430/527; 430/531; 430/533; 430/631

[58] Field of Search ..... 427/489, 491, 427/533, 537, 539, 576, 226, 229; 430/531, 533, 564, 631, 527, 530

[56] References Cited

U.S. PATENT DOCUMENTS

| | | | |
|---|---|---|---|
| 3,163,665 | 12/1964 | Fitch | 260/430 |
| 3,956,524 | 5/1976 | Weigl | 427/537 |
| 4,140,814 | 2/1979 | Hynecek . | |
| 4,252,838 | 2/1981 | Boord et al. . | |
| 4,374,158 | 2/1983 | Taniguchi et al. | 427/536 |
| 4,464,416 | 8/1984 | Liepins | 427/576 |
| 4,694,138 | 9/1987 | Oodaira et al. | 427/229 |
| 4,717,587 | 1/1988 | Suhr et al. . | |
| 4,735,832 | 4/1988 | Ichikawa et al. | 427/489 |
| 4,780,354 | 10/1988 | Nakayama et al. | 427/537 |
| 4,814,199 | 3/1989 | Boccalon et al. | 427/535 |
| 5,013,581 | 5/1991 | Suhr et al. . | |
| 5,112,676 | 5/1992 | Cot et al. | 427/226 |
| 5,137,560 | 8/1992 | Ohmura et al. | 427/226 |
| 5,137,749 | 8/1992 | Yamazaki et al. | 427/226 |
| 5,147,688 | 9/1992 | Melas . | |
| 5,236,737 | 8/1993 | Linton | 427/126.3 |
| 5,252,356 | 10/1993 | Yoshida et al. | 427/226 |
| 5,270,267 | 12/1993 | Ouellet | 427/535 |
| 5,372,923 | 12/1994 | Kurachi et al. | 430/527 |
| 5,468,514 | 11/1995 | Tomita | 427/226 |
| 5,496,690 | 3/1996 | Machida et al. | 430/533 |
| 5,516,458 | 5/1996 | Lelental et al. | 430/527 |
| 5,605,723 | 2/1997 | Ogi et al. | 427/533 |
| 5,681,687 | 10/1997 | Lelental et al. | 430/530 |

FOREIGN PATENT DOCUMENTS

| | | | |
|---|---|---|---|
| 56-082504 | 7/1981 | Japan | 427/539 |
| 60-160508 | 8/1985 | Japan | 427/539 |
| 62-103622 | 5/1987 | Japan | 427/539 |
| 62-116773 | 5/1987 | Japan | 427/535 |
| 1-187713 | 7/1989 | Japan | 427/535 |
| 4-149090 | 5/1992 | Japan | 427/535 |
| 4-171611 | 6/1992 | Japan | 427/535 |

OTHER PUBLICATIONS

Translation of JP 62–116773 (Ricoh KK, Narito Oshima et al) May 28, 1987.

Translation of JP01–187713 (Nippon sheetglass, Ryuichi Shiratsuchi et al) Jul. 27, 1989.

*Primary Examiner*—Marianne Padgett

*Attorney, Agent, or Firm*—Carl F. Ruoff

[57] ABSTRACT

Imaging elements, such as photographic, electrostatographic and thermal imaging elements, are comprised of a support, an image-forming layer and an electrically-conductive layer produced by coating a layer comprised of a metallo-organic compound and a film-forming binder and subjecting such layer to glow discharge treatment to render it electrically conductive. Use of a metallo-organic compound in combination with a glow discharge treatment provides a controlled degree of electrical conductivity and beneficial chemical, physical and optical properties which adapt the electrically-conductive layer for such purposes as providing protection against static or serving as an electrode which takes part in an image-forming process.

8 Claims, 1 Drawing Sheet

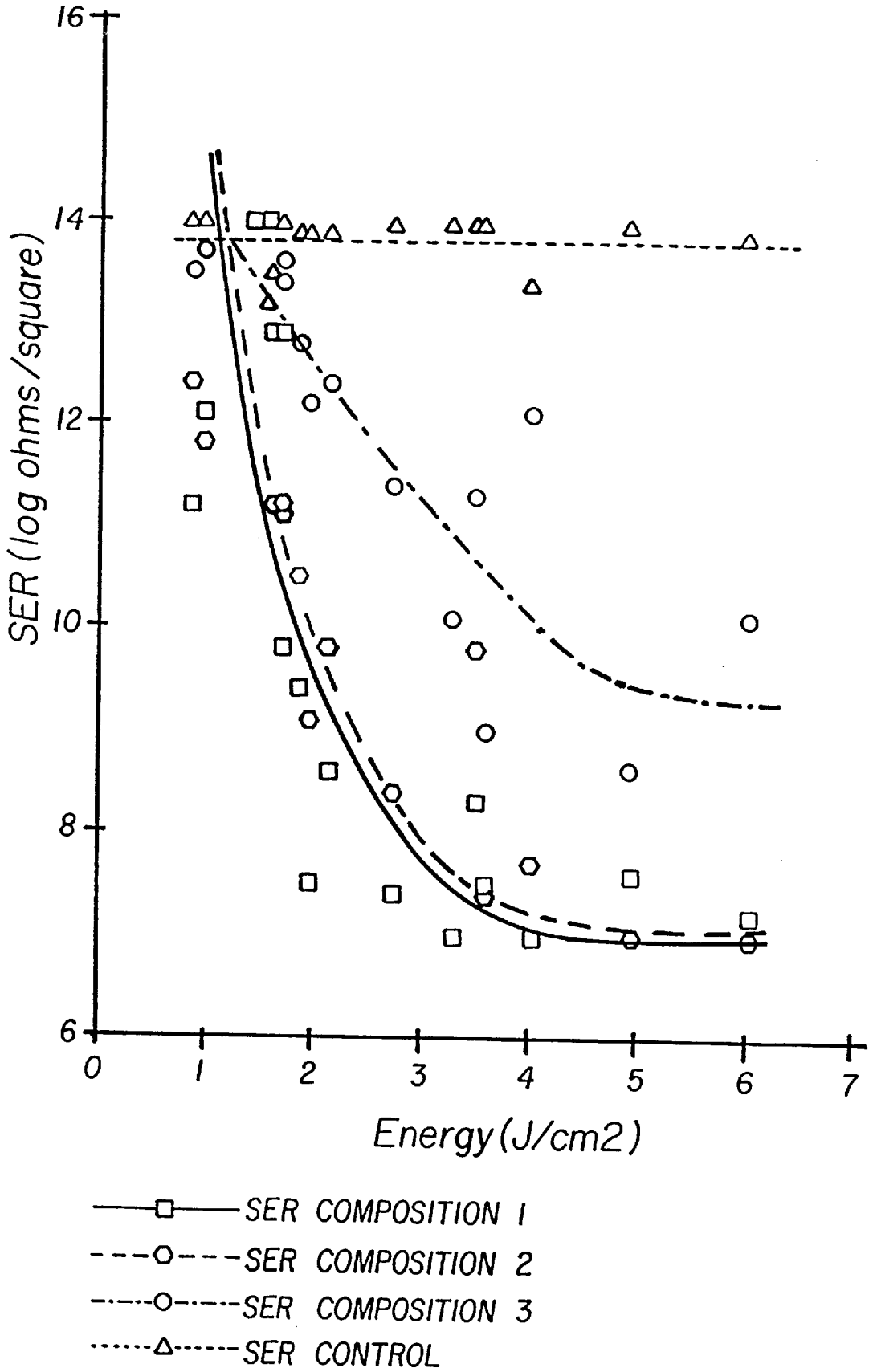
16
14
12
10
8
6
SER (log ohms/square)
0
1
2
3
4
5
6
7
Energy (J/cm2)
SER COMPOSITION 1
SER COMPOSITION 2
SER COMPOSITION 3
SER CONTROL

IMAGING ELEMENT COMPRISING AN ELECTRICALLY CONDUCTIVE LAYER FORMED BY A GLOW DISCHARGE PROCESS

This is a Continuation of application Ser. No. 08/439,199, filed May 11, 1995 now abandoned which is a Divisional of application Ser. No. 08/297,993, now abandoned, filed Aug. 30, 1994.

FIELD OF THE INVENTION

This invention relates in general to imaging elements, such as photographic, electrostatographic and thermal imaging elements, and in particular to imaging elements comprising a support, an image-forming layer and an electrically-conductive layer. More specifically, this invention relates to electrically-conductive layers formed by a glow discharge process and to the use of such electrically-conductive layers in imaging elements for such purposes as providing protection against the generation of static electrical charges or serving as an electrode which takes part in an image-forming process.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal from light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. Most of the traditional antistatic systems for photographic applications employ ionic conductors. Charge is transferred in ionic conductors by the bulk diffusion of charged species through an electrolyte. Antistatic layers containing simple inorganic salts, alkali metal salts of surfactants, ionic conductive polymers, polymeric electrolytes containing alkali metal salts, and colloidal metal oxide sols (stabilized by metal salts) have been described previously. The conductivities of these ionic conductors are typically strongly dependent on the temperature and relative humidity in their environment. At low humidities and temperatures, the diffusional mobilities of the ions are greatly reduced and conductivity is substantially decreased. At high humidities, antistatic backcoatings often absorb water, swell, and soften. In roll film, this results in adhesion of the backcoating to the emulsion side of the film. Also, many of the inorganic salts, polymeric electrolytes, and low molecular weight surfactants used are water-soluble and are leached out of the antistatic layers during processing, resulting in a loss of antistatic function.

Colloidal metal oxide sols which exhibit ionic conductivity when included in antistatic layers are often used in imaging elements. Typically, alkali metal salts or anionic surfactants are used to stabilize these sols. A thin antistatic layer consisting of a gelled network of colloidal metal oxide particles (e.g., silica, antimony pentoxide, alumina, titania, stannic oxide, zirconia) with an optional polymeric binder to improve adhesion to both the support and overlying emulsion layers has been disclosed in EP 250,154. An optional ambifunctional silane or titanate coupling agent can be added to the gelled network to improve adhesion to overlying emulsion layers (e.g., EP 301,827; U.S. Pat. No. 5,204,219) along with an optional alkali metal orthosilicate to minimize loss of conductivity by the gelled network when it is overcoated with gelatin-containing layers (U.S. Pat. No. 5,236,818). Also, it has been pointed out that coatings containing colloidal metal oxides (e.g., antimony pentoxide, alumina, tin oxide, indium oxide) and colloidal silica with an organopolysiloxane binder afford enhanced abrasion resistance as well as provide antistatic function (U.S. Pat. Nos. 4,442,168 and 4,571,365).

Antistatic systems employing electronic conductors have also been described. Because the conductivity depends predominantly on electronic mobilities rather than ionic mobilities, the observed electronic conductivity is independent of relative humidity and only slightly influenced by the ambient temperature. Antistatic layers have been described which contain conjugated polymers, conductive carbon particles or semiconductive inorganic particles.

Trevoy (U.S. Pat. No. 3,245,833) has taught the preparation of conductive coatings containing semiconductive silver or copper iodide dispersed as particles less than 0.1 $\mu$m in size in an insulating film-forming binder, exhibiting a surface resistivity of $10^2$ to $10^{11}$ ohms per square. The conductivity of these coatings is substantially independent of the relative humidity. Also, the coatings are relatively clear and sufficiently transparent to permit their use as antistatic coatings for photographic film. However, if a coating containing copper or silver iodides was used as a subbing layer on the same side of the film base as the emulsion, Trevoy found (U.S. Pat. No. 3,428,451) that it was necessary to overcoat the conductive layer with a dielectric, water-impermeable barrier layer to prevent migration of semiconductive salt into the silver halide emulsion layer during processing. Without the barrier layer, the semiconductive salt could interact deleteriously with the silver halide layer to form fog and a loss of emulsion sensitivity. Also, without a barrier layer, the semiconductive salts are solubilized by processing solutions, resulting in a loss of antistatic function.

Another semiconductive material has been disclosed by Nakagiri and Inayama (U.S. Pat. No. 4,078,935) as being useful in antistatic layers for photographic applications. Transparent, binderless, electrically semiconductive metal oxide thin films were formed by oxidation of thin metal films which had been vapor deposited onto film base. Suitable transition metals include titanium, zirconium, vanadium, and niobium. The microstructure of the thin metal oxide films is revealed to be non-uniform and discontinuous, with an "island" structure almost "particulate" in nature. The surface resistivity of such semiconductive metal oxide thin films is independent of relative humidity and reported to range from $10^5$ to $10^9$ ohms per square. However, the metal oxide thin films are unsuitable for photographic applications since the overall process used to prepare these thin films is complicated and costly, abrasion resistance of these thin films is low, and adhesion of these thin films to the base is poor.

A highly effective antistatic layer incorporating an "amorphous" semiconductive metal oxide has been disclosed by Guestaux (U.S. Pat. No. 4,203,769). The antistatic layer is prepared by coating an aqueous solution containing a colloidal gel of vanadium pentoxide onto a film base. The colloidal vanadium pentoxide gel typically consists of entangled, high aspect ratio, flat ribbons 50–100 Å wide, about 10 Å thick, and 1,000–10,000 Å long. These ribbons stack flat in the direction perpendicular to the surface when the gel is coated onto the film base. This results in electrical conductivities for thin films of vanadium pentoxide gels (about 1 $\Omega^{-1}$ $cm^{-1}$) which are typically about three orders of magnitude greater than is observed for similar thickness films containing crystalline vanadium pentoxide particles. In addition, low surface resistivities can be obtained with very low vanadium pentoxide coverages. This results in low optical absorption and scattering losses. Also, the thin films are highly adherent to appropriately prepared film bases. However, vanadium pentoxide is soluble at high pH and must be overcoated with a non-permeable, hydrophobic barrier layer in order to survive processing. When used with a conductive subbing layer, the barrier layer must be coated with a hydrophilic layer to promote adhesion to emulsion layers above. (See Anderson et al, U.S. Pat. No. 5,006,451.)

Conductive fine particles of crystalline metal oxides dispersed with a polymeric binder have been used to prepare optically transparent, humidity insensitive, antistatic layers for various imaging applications. Many different metal oxides—such as ZnO, $TiO_2$, $ZrO_2$, $SnO_2$, $Al_2O_3$, $In_2O_3$, $SiO_2$, MgO, BaO, $MoO_3$ and $V_2O_5$—are alleged to be useful as antistatic agents in photographic elements or as conductive agents in electrostatographic elements in such patents as U.S. Pat. Nos. 4,275,103, 4,394,441, 4,416,963, 4,418,141, 4,431,764, 4,495,276, 4,571,361, 4,999,276 and 5,122,445. However, many of these oxides do not provide acceptable performance characteristics in these demanding environments. Preferred metal oxides are antimony doped tin oxide, aluminum doped zinc oxide, and niobium doped titanium oxide. Surface resistivities are reported to range from $10^6$–$10^9$ ohms per square for antistatic layers containing the preferred metal oxides. In order to obtain high electrical conductivity, a relatively large amount (0.1–10 $g/m^2$) of metal oxide must be included in the antistatic layer. This results in decreased optical transparency for thick antistatic coatings. The high values of refractive index (>2.0) of the preferred metal oxides necessitates that the metal oxides be dispersed in the form of ultrafine (<0.1 $\mu$m) particles in order to minimize light scattering (haze) by the antistatic layer.

Antistatic layers comprising electro-conductive ceramic particles, such as particles of TiN, $NbB_2$, TiC, $LaB_6$ or MoB, dispersed in a binder such as a water-soluble polymer or solvent-soluble resin are described in Japanese Kokai No. 4/55492, published Feb. 24, 1992.

An electrically-conductive layer can be applied to a non-conductive substrate by introducing a metallo-organic compound in gaseous form into a glow discharge zone and thereby depositing a metal-containing electroconductive layer on the substrate as described, for example, in U.S. Pat. Nos. 4,252,838 and 4,717,587. However, this process is time-consuming, costly and difficult to control and it is very difficult to obtain a layer of uniform thickness and with uniform electroconductivity.

Fibrous conductive powders comprising antimony-doped tin oxide coated onto non-conductive potassium titanate whiskers have been used to prepare conductive layers for photographic and electrographic applications. Such materials are disclosed, for example, in U.S. Pat. Nos. 4,845,369 and 5,116,666. Layers containing these conductive whiskers dispersed in a binder reportedly provide improved conductivity at lower volumetric concentrations than other conductive fine particles as a result of their higher aspect ratio. However, the benefits obtained as a result of the reduced volume percentage requirements are offset by the fact that these materials are relatively large in size such as 10 to 20 micrometers in length, and such large size results in increased light scattering and hazy coatings.

Use of a high volume percentage of conductive particles in an electro-conductive coating to achieve effective antistatic performance can result in reduced transparency due to scattering losses and in the formation of brittle layers that are subject to cracking and exhibit poor adherence to the support material It is thus apparent that it is extremely difficult to obtain non-brittle, adherent, highly transparent, colorless electro-conductive coatings with humidity-independent process-surviving antistatic performance.

The requirements for antistatic layers in silver halide photographic films are especially demanding because of the stringent optical requirements. Other types of imaging elements such as photographic papers and thermal imaging elements also frequently require the use of an antistatic layer but, generally speaking, these imaging elements have less stringent requirements.

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact, for example, the aqueous alkaline developing solutions used to process silver halide photographic films.

It is toward the objective of providing improved electrically-conductive layers that more effectively meet the diverse needs of imaging elements—especially of silver halide photographic films but also of a wide range of other imaging elements—than those of the prior art that the present invention is directed.

SUMMARY OF THE INVENTION

The present invention provides a novel method of forming an electrically-conductive layer on a support material, thereby producing an electrically-conductive material that is useful as a base for an imaging element. Imaging elements in accordance with the invention are comprised of a support, an image-forming layer and an electrically-conductive layer produced by the aforesaid method.

The method of this invention comprises the steps of:

(1) providing a support;

(2) forming a coating composition comprising a metallo-organic compound and a film-forming binder;

(3) coating a layer of the coating composition on the surface of the support; and (4) subjecting the layer to glow discharge treatment for a period of time sufficient to render it electrically-conductive.

It is a particular advantage of the method of this invention that it serves to provide a layer with excellent conductivity characteristics without significantly degrading supports commonly used with imaging elements, such as the polyethylene terephthalate, cellulose triacetate, and polyethylene-coated paper supports widely utilized in photographic elements.

Preferably the metallo-organic compound utilized in this invention is a compound of a metal selected from groups II, III, IV, V or VI of the periodic table of the elements. Mixtures of two or more metallo-organic compounds are especially preferred, with a particularly advantageous mixture being a mixture of a metallo-organic compound of tin and a metallo-organic compound of antimony.

The imaging elements of this invention can contain one or more image-forming layers and one or more electrically-conductive layers and such layers can be coated on any of a very wide variety of supports. Use of metallo-organic compounds in combination with glow discharge treatment enables the preparation of a thin, highly conductive, transparent layer which is strongly adherent to photographic supports as well as to overlying layers such as emulsion layers, pelloids, topcoats, backcoats, and the like.

BRIEF DESCRIPTION OF THE DRAWING

The FIGURE shows a plot of sheet resistivity (SER) in log ohms/square verses energy input in J/cm$^2$ for three different SER compositions and a control.

DESCRIPTION OF THE PREFERRED EMBODIMENTS

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly (vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum-paper laminate, (b) metal plates, e.g., aluminum, copper, zinc, brass, etc., (c) metal foils such as aluminum foil, zinc foil, etc., (d) vapor deposited metal layers such as silver, aluminum, nickel, etc., (e) semiconductors dispersed in resins such as poly (ethylene terephthalate) as described in U.S. Pat. No. 3,245,833, (f) electrically conducting salts such as described in U.S. Pat. Nos. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, *Research Disclosure,* June 1978, Item No. 17029; U.S. Pat. No. 3,457,075; U.S. Pat. No. 3,933,508; and U.S. Pat. No. 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R. W. Gundlach, "Xeroprinting Master with Improved Contrast Potential", *Xerox Disclosure Journal,* Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng, and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force.

An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R. M. Schaffert, *Electrophotography,* (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non-photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing step may also be needed, depending on the exposure levels.

Another example of imaging elements which employ an antistatic layer are dye-receiving elements used in thermal dye transfer systems.

Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. No. 4,621,271.

In EPA No. 194,106, antistatic layers are disclosed for coating on the back side of a dye-receiving element. Among the materials disclosed for use are electrically-conductive inorganic powders such as a "fine powder of titanium oxide or zinc oxide."

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. Nos. 4,343,880 and 4,727,008.

In the imaging elements of this invention, the image-forming layer can be any of the types of image-forming layers described above, as well as any other image-forming layer known for use in an imaging element.

All of the imaging processes described hereinabove, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

As described hereinabove, the imaging elements of this invention include at least one electrically-conductive layer formed by a process in which a metallo-organic compound and a film-forming binder are coated on a support surface and the resulting non-conductive coating is transformed into an electrically-conductive coating by means of a glow discharge treatment.

Any metallo-organic compound which can be combined with a film-forming binder, coated in the form of a thin layer, and converted to an electroconductive composition by the action of a glow discharge on the coated layer can be utilized in the present invention.

Examples of suitable metallo-organic compounds for use in this invention include:
metal carboxylates,
metal alkoxides,
metal halides,
metal alkyls,
β-diketone derivatives of metals,
metal carbonyls,
cyclopentadienyl complexes of metals,
and the like.

The metallo-organic compound is preferably a compound of one of the metals of groups II, III, IV, V or VI of the periodic table of the elements, and most preferably of one of the metals of group IV. Particularly useful metals include tin, indium, zinc, aluminum, cadmium, molybdenum, antimony, bismuth and vanadium. Metallo-organic compounds of two or more metals can be combined to form the electrically-conductive layer. Non-metallic compounds, such as fluorine, which act as dopants can also be included.

Specific metallo-organic compounds which can be advantageously employed in this invention include:
tin 2-ethylhexanoate,
antimony tributoxide,
tetramethyl tin,
tetraethyl tin,
tri-n-butyltin methoxide,
tin naphthenate,
tin neodecanoate,
antimony isopropoxide,
tin cyclohexanebutyrate,
antimony methoxide,
antimony ethoxide,
antimony ethylenelgycoxide,
tin tetrachloride,
tri-n-propyltin chloride,
tri-n-butyltin acetate,
di-n-butyltin diacetate,
diphenyltin oxide,
bis(tri-n-butyltin)oxide,
di-n-butyltin oxide,
diallyldibutyltin,
di-n-butyltinbis(2-ethylhexanoate)
di-n-butyltin dilaurate,
and the like.

Any film-forming binder, organic or inorganic in nature, which can be coated together with a metallo-organic compound to form a thin layer which can be rendered electrically-conductive by glow discharge treatment can be utilized in the present invention.

Film-forming polymers, either natural or synthetic, are typically utilized in the present invention to form a composition which can be coated as a uniform layer on the support. Such film-forming polymers include: water-soluble polymers such as gelatin, gelatin derivatives, maleic acid anhydride copolymers; cellulose compounds such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamides, their derivatives and partially hydrolyzed products, vinyl polymers and copolymers such as polyvinyl acetate and polyacrylate acid esters; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, olefins, and aqueous dispersions of polyurethanes or polyesterionomers. A particularly preferred film-forming binder is polyvinyl butyral.

Useful inorganic binders include polyinorganic polymers such as polyphosphazenes, polysiloxanes and polysilanes. If desired, blends of organic and inorganic polymers can be used as the film-forming binder.

Solvents or diluents can be included in the coating composition to provide a suitable viscosity for coating. Useful solvents or diluents include: water, alcohols such as methanol, ethanol, propanol, and isopropanol; ketones such as acetone, methylethyl ketone, and methylisobutyl ketone; esters such as methyl acetate and ethyl acetate; glycol ethers such as methyl cellusolve, ethyl cellusolve; and mixtures thereof.

Coating compositions containing a metallo-organic compound and a film-forming binder in accordance with this invention can be coated on a very wide variety of supports. Suitable film supports include polyethylene terephthalate, polyethylene naphthalate, polycarbonate, polystyrene, cellulose nitrate, cellulose acetate, cellulose acetate butyrate, cellulose acetate propionate, and laminates thereof. Use of supports having a co-extruded subbing layer is particularly useful in this invention. Film supports can be either transparent or opaque depending on the application. Transparent film supports can be either colorless or colored by the addition of a dye or pigment. Film supports can be surface treated by various processes including corona discharge, glow discharge, UV exposure, solvent washing or overcoated with polymers such as vinylidene chloride containing copolymers, butadiene-based copolymers, glycidyl acrylate or methacrylate containing copolymers, or maleic anhydride containing copolymers. Suitable paper supports include polyethylene-, polypropylene-, and ethylene-butylene copolymer-coated or laminated paper and synthetic papers.

The coating compositions utilized in this invention can be applied to the aforementioned film or paper supports by any of a variety of well-known coating methods. Handcoating techniques include using a coating rod or knife or a doctor blade. Machine coating methods include skim pan/air knife coating, roller coating, gravure coating, curtain coating, bead coating or slide coating. After the layer containing the metallo-organic compound is coated it is typically subjected to a suitable drying procedure, such as drying by hot air impingement, before it is subjected to the glow discharge treatment.

The dry thickness of the coated layer containing the metallo-organic compound is not critical. Suitable thicknesses range, for example, from about 0.05 to about 50 micrometers.

It is also contemplated that the electrically-conductive layer described herein can be used in imaging elements in which a relatively transparent layer containing magnetic particles dispersed in a binder is included. The electrically-conductive layer of this invention functions well in such a combination and gives excellent photographic results. Transparent magnetic layers are well known and are described, for example, in U.S. Pat. No. 4,990,276, European Patent 459,349, and *Research Disclosure,* Item 34390, November, 1992, the disclosures of which are incorporated herein by reference. As disclosed in these publications, the magnetic particles can be of any type available such as ferro- and ferri-magnetic oxides, complex oxides with other metals, ferrites, etc. and can assume known particulate shapes and sizes, may contain dopants, and may exhibit the pH values known in the art. The particles may be shell coated and may be applied over the range of typical laydown.

Imaging elements incorporating conductive layers of this invention are useful for many specific applications such as color negative films, color reversal films, black-and-white films, color and black-and-white papers, graphic arts films, x-ray films, electrophotographic media, thermal dye transfer recording media etc. The invention is especially useful in forming a durable abrasion-resistant antistatic backing layer on the side of a photographic film opposite to the silver halide emulsion layer.

In a preferred embodiment of the invention, a mixture of organo-metallic compounds is employed, one being a tin carboxylate of 1 to 30 and more preferably 4 to 20 carbon atoms and the other being an antimony alkoxide of 1 to 30 and more preferably 4 to 20 carbon atoms.

In addition to the combination of a tin compound and an antimony compound, other particularly useful mixtures include a tin compound and an indium compound, a tin compound and a zinc compound, a tin compound and a cadmium compound, a zinc compund and an aluminum compound and a zinc compound and an indium compound.

In a particularly preferred embodiment of the invention, the coating composition is comprised of a mixture of tin 2-ethylhexanoate and antimony tributoxide. In this composition, a preferred diluent is butanol and a preferred film-forming binder is polyvinyl butyral. The use of polyvinyl butyral is particularly advantageous because it is an excellent film-former and because it is soluble in butanol, an alcohol with which both tin-2-ethylhexanoate and antimony tributoxide are fully miscible.

Processes employing glow discharge and the equipment for generating a glow discharge are well known and widely used in industry and any such process and equipment can be adapted for use in this invention.

Glow discharge occurs by applying a high electrical potential to a set of electrodes disposed in an evacuated chamber. Typically, the cathode is biased relative to an anode or shield. Voltages employed in operating the glow discharge apparatus are typically in the range of from about 100 to about 1000 volts.

Glow discharge processes are carried out at reduced pressure, typically a pressure in the range of from about 0.01 to about 1 Torr. Thus, they do not require a high vacuum environment such as is required in vacuum evaporation processes. In using glow discharge it is not necessary to heat the support so that the process is suitably conducted at room temperature.

The glow discharge can be established and maintained by a DC, AC, RF or microwave electromagnetic field. The apparatus is typically operated at a power of about 30 to 3000 watts per meter of cathode length. Alternating current with a frequency in the range of from about 60 Hz to about 300 MHz is preferred.

The principles of glow discharge treatment are well known. When an electric field is applied to a gas kept at a reduced pressure, free electrons which are present in a minor proportion in the gas and have a remarkably greater mean free path than under atmospheric pressure are accelerated under the electric field to gain kinetic energy (electron temperature). These accelerated electrons collide with atoms and molecules to produce a variety of species such as electrons, ions, neutral radicals, excited atoms, excited molecules, etc. The dissociated electrons are again accelerated under the electric field to dissociate further atoms and molecules. When this chain reaction creates ions at a rate comparable to their recombination, a steady glow discharge results. Glow discharges of this type are considered low temperature plasmas, as the energy distribution of neutrals and ions are not much different from those of a room temperature gas. However, the electron energies are considerably higher, on the order of a few eV.

A convenient procedure for carrying out the glow discharge treatment of this invention is to convey a web of support material having the layer containing the metallo-organic compound on one surface thereof through an evacuated chamber comprising a treatment zone. A suitable pressure of oxygen or other gas is maintained in the treatment zone to sustain the glow discharge. The web is conveyed at a suitable speed, for example a speed in the range of about 0.2 to about 300 meters per minute, with the coated layer positioned beneath the glow discharge cathode. The speed of travel is selected to provide a suitable residence time over which the glow discharge impinges on the coating, for example a time in the range of from about 0.03 to about 15 seconds. The mechanism whereby the glow discharge functions to convert the non-conductive layer to an electrically-conductive layer is not clearly understood but decomposition of the metallo-organic compound is believed to occur along with some degradation of the film-forming binder.

In the method of this invention, it is preferred that the weight ratio of metallo-organic compound to film-forming binder is at least about two to one and more preferably at least about three to one. It is also preferred that the glow discharge treatment provides an energy input to the layer of at least about three Joules per square centimeter and more preferably at least about four Joules per square centimeter. This energy input is controlled by the glow discharge power and the web speed.

In carrying out the glow discharge process employed in this invention, oxygen is typically introduced into the vacuum chamber to establish and sustain the glow discharge. While the mechanism whereby oxygen functions in the process is not known, it is believed that the presence of oxygen in the chamber significantly affects the processes that occur and contributes to the desired result of high electrical conductivity. Other gases in addition to oxygen can be introduced into the vacuum chamber in order to carry out the glow discharge process. Examples of such gases include air, nitrogen, helium, neon, argon, krypton, xenon and radon. The addition of reactive gases such as oxygen, hydrogen, ammonia or water vapor changes the nature of the discharge.

The invention is further illustrated by the following examples of its practice.

EXAMPLES 1–17

A coating composition designated Composition 1 was prepared by combining 176.4 milliliters of reagent grade tin 2-ethylhexanoate, 15.6 milliliters of reagent grade antimony tributoxide, 74.1 milliliters of butanol and 528.6 milliliters of an 11.2% by weight solution of polyvinyl butyral dissolved in butanol.

A coating composition designated Composition 2 was prepared by diluting Composition 1 with 792.9 milliliters of an 11.2% by weight solution of polyvinyl butyral dissolved in butanol.

A coating composition designated Composition 3 was prepared by diluting Composition 1 with 2114.4 milliliters of an 11.2% by weight solution of polyvinyl butyral dissolved in butanol.

The weight ratio of metallo-organic compound to binder was 5 to 1 in Composition 1, 2 to 1 in Composition 2, and 1 to 1 in Composition 3.

A control coating composition containing no metallo-organic compound consisted of an 11.2% by weight solution of polyvinyl butyral dissolved in butanol.

Each of coating Compositions 1, 2 and 3 and the control composition were coated on a polyethylene terephthalate film support that had been subbed with a vinylidene chloride/acrylonitrile/itaconic acid terpolymer. The wet coverage of coating composition was 20 milliliters per square meter. Drying was carried out at a temperature of 65° C. for 7 minutes.

Glow discharge treatment of the coated film samples was carried out using a web transport system to convey the samples in a vacuum chamber equipped with a 5kVA AC power supply. The film samples were cut into strips and the strips were taped to the transport web, with the coated layer facing upward so that it was exposed to the glow discharge as the transport web passed through the treatment zone. Pure oxygen (99.999% pure) was metered into the vacuum chamber by means of suitable mass flow controllers. Before the oxygen was admitted, the vacuum chamber was pumped to a pressure of less than $5\times10^{-5}$ mbar.

Glow discharge tests were carried out under seventeen different sets of conditions which differed in terms of oxygen pressure, cathode power and web speed. After completion of these tests, the sixty-eight samples were incubated for 24 hours at room temperature and 50% relative humidity and the sheet resistance (SER) of each sample was measured using a parallel electrode method. Results of the tests are reported in Table I below which specifies the oxygen pressure, the current, the voltage, the power, the web speed in meters per minute, the resultant energy input in joules/$cm^2$ and the measured resistivity in log ohms per square.

TABLE I

| Example No. | Coating | Pressure of Oxygen (mTorr) | Current (mAmps) | Voltage (Volts) | IV (Watts) | Web Speed m/min | Energy J/$cm^2$ | SER (50%RH) log (ohm/sq) |
|---|---|---|---|---|---|---|---|---|
| 1 | 1 | 45 | 1000 | 980 | 980 | 0.37 | 3.6 | 7.5 |
| | 2 | 45 | 1000 | 980 | 980 | 0.37 | 3.6 | 7.4 |
| | 3 | 45 | 1000 | 980 | 980 | 0.37 | 3.6 | 9 |
| | Control | 45 | 1000 | 980 | 980 | 0.37 | 3.6 | 14 |
| 2 | 1 | 45 | 1000 | 1000 | 1000 | 0.49 | 2.75 | 7.4 |
| | 2 | 45 | 1000 | 1000 | 1000 | 0.49 | 2.75 | 8.4 |
| | 3 | 45 | 1000 | 1000 | 1000 | 0.49 | 2.75 | 11.4 |
| | Control | 45 | 1000 | 1000 | 1000 | 0.49 | 2.75 | 14 |
| 3 | 1 | 55 | 1000 | 900 | 900 | 0.24 | 4.95 | 7.6 |
| | 2 | 55 | 1000 | 900 | 900 | 0.24 | 4.95 | <7 |
| | 3 | 55 | 1000 | 900 | 900 | 0.24 | 4.95 | 8.6 |
| | Control | 55 | 1000 | 900 | 900 | 0.24 | 4.95 | 14 |
| 4 | 1 | 35 | 1000 | 1100 | 1100 | 0.37 | 4.03 | <7 |
| | 2 | 35 | 1000 | 1100 | 1100 | 0.37 | 4.03 | 7.7 |
| | 3 | 35 | 1000 | 1100 | 1100 | 0.37 | 4.03 | 12.1 |
| | Control | 35 | 1000 | 1100 | 1100 | 0.37 | 4.03 | 13.4 |
| 5 | 1 | 35 | 1000 | 1100 | 1100 | 0.24 | 6.05 | 7.2 |
| | 2 | 35 | 1000 | 1100 | 1100 | 0.24 | 6.05 | 7 |
| | 3 | 35 | 1000 | 1100 | 1100 | 0.24 | 6.05 | 10.1 |
| | Control | 35 | 1000 | 1100 | 1100 | 0.24 | 6.05 | 13.9 |
| 6 | 1 | 55 | 1000 | 900 | 900 | 0.37 | 3.3 | <7 |
| | 2 | 55 | 1000 | 900 | 900 | 0.37 | 3.3 | 7 |
| | 3 | 55 | 1000 | 900 | 900 | 0.37 | 3.3 | 10.1 |
| | Control | 55 | 1000 | 900 | 900 | 0.37 | 3.3 | 14 |
| 7 | 1 | 55 | 1600 | 900 | 1440 | 1.22 | 1.58 | 14 |
| | 2 | 55 | 1600 | 900 | 1440 | 1.22 | 1.58 | 14 |

TABLE I-continued

| Example No. | Coating | Pressure of Oxygen (mTorr) | Current (mAmps) | Voltage (Volts) | IV (Watts) | Web Speed m/min | Energy J/cm$^2$ | SER (50%RH) log (ohm/sq) |
|---|---|---|---|---|---|---|---|---|
| | 3 | 55 | 1600 | 900 | 1440 | 1.22 | 1.58 | 14 |
| | Control | 55 | 1600 | 900 | 1440 | 1.22 | 1.58 | 13.2 |
| 8 | 1 | 55 | 1600 | 1000 | 1600 | 0.61 | 3.52 | 8.3 |
| | 2 | 55 | 1600 | 1000 | 1600 | 0.61 | 3.52 | 9.8 |
| | 3 | 55 | 1600 | 1000 | 1600 | 0.61 | 3.52 | 11.3 |
| | Control | 55 | 1600 | 1000 | 1600 | 0.61 | 3.52 | 14 |
| 9 | 1 | 45 | 1300 | 900 | 1170 | 0.91 | 1.72 | 9.8 |
| | 2 | 45 | 1300 | 900 | 1170 | 0.91 | 1.72 | 11.1 |
| | 3 | 45 | 1300 | 900 | 1170 | 0.91 | 1.72 | 13.4 |
| | Control | 45 | 1300 | 900 | 1170 | 0.91 | 1.72 | 14 |
| 10 | 1 | 35 | 1000 | 900 | 900 | 0.61 | 1.98 | 7.5 |
| | 2 | 35 | 1000 | 900 | 900 | 0.61 | 1.98 | 9.1 |
| | 3 | 35 | 1000 | 900 | 900 | 0.61 | 1.98 | 12.2 |
| | Contro1 | 35 | 1000 | 800 | 800 | 0.61 | 1.98 | 13.9 |
| 11 | 1 | 35 | 1600 | 800 | 1280 | 1.22 | 1.41 | 14 |
| | 2 | 35 | 1600 | 800 | 1280 | 1.22 | 1.41 | 14 |
| | 3 | 35 | 1600 | 800 | 1280 | 1.22 | 1.41 | 14 |
| | Control | 35 | 1600 | 800 | 1280 | 1.22 | 1.41 | 14 |
| 12 | 1 | 55 | 1000 | 800 | 800 | 1.22 | 0.88 | 11.2 |
| | 2 | 55 | 1000 | 800 | 800 | 1.22 | 0.88 | 12.4 |
| | 3 | 55 | 1000 | 800 | 800 | 1.22 | 0.88 | 13.5 |
| | Control | 55 | 1000 | 800 | 800 | 1.22 | 0.88 | 14 |
| 13 | 1 | 45 | 1300 | 760 | 988 | 0.61 | 2.17 | 8.6 |
| | 2 | 45 | 1300 | 760 | 988 | 0.61 | 2.17 | 9.8 |
| | 3 | 45 | 1300 | 760 | 988 | 0.61 | 2.17 | 12.4 |
| | Control | 45 | 1300 | 760 | 988 | 0.61 | 2.17 | 13.9 |
| 14 | 1 | 45 | 1600 | 800 | 1280 | 0.91 | 1.88 | 9.4 |
| | 2 | 45 | 1600 | 800 | 1280 | 0.91 | 1.88 | 10.5 |
| | 3 | 45 | 1600 | 800 | 1280 | 0.91 | 1.88 | 12.8 |
| | Control | 45 | 1600 | 800 | 1280 | 0.91 | 1.88 | 13.9 |
| 15 | 1 | 55 | 1300 | 850 | 1105 | 0.91 | 1.62 | 12.9 |
| | 2 | 55 | 1300 | 850 | 1105 | 0.91 | 1.62 | 11.2 |
| | 3 | 55 | 1300 | 850 | 1105 | 0.91 | 1.62 | 12.9 |
| | Control | 55 | 1300 | 850 | 1105 | 0.91 | 1.62 | 13.5 |
| 16 | 1 | 35 | 1000 | 900 | 900 | 1.22 | 0.99 | 12.1 |
| | 2 | 35 | 1000 | 900 | 900 | 1.22 | 0.99 | 11.8 |
| | 3 | 35 | 1000 | 900 | 900 | 1.22 | 0.99 | 13.7 |
| | Control | 35 | 1000 | 900 | 900 | 1.22 | 0.99 | 14 |
| 17 | 1 | 45 | 1300 | 900 | 1170 | 0.91 | 1.72 | 12.9 |
| | 2 | 45 | 1300 | 900 | 1170 | 0.91 | 1.72 | 11.2 |
| | 3 | 45 | 1300 | 900 | 1170 | 0.91 | 1.72 | 13.6 |
| | Control | 45 | 1300 | 900 | 1170 | 0.91 | 1.72 | 14 |

As shown by the data in Table I, use of coating compositions 1, 2, or 3, which contained the metallo-organic compounds, generally provided much lower resistivity than use of the control coating composition which contained no metallo-organic compound. Generally speaking, the lowest resistivity was obtained by the use of coating composition 1 which had a higher ratio of metallo-organic compound to polymeric binder than compositions 2 and 3.

The data reported in Table I are tabulated in Table II in terms of increasing energy input as measured in joules per square centimeter and the data of Table II are plotted in the attached FIGURE to illustrate the effect on resistivity of both energy input and variation in the make-up of the coating composition. The plot clearly shows that the lowest resistivity values are obtained by using higher energy inputs, e.g., an input of at least about three joules per square centimeter and preferably at least about four joules per square centimeter. Also, the plot indicates that the higher ratio of metallo-organic compound in Composition 2 as compared to Composition 3 gave much better results whereas further increasing the ratio from 2 to 1 to 5 to 1 in going from Composition 2 to Composition 1 only provided a slight improvement in performance.

TABLE II

| Energy J/cm$^2$ | SER (log ohm/sq) Comp. 1 | SER (log ohm/sq) Comp. 2 | SER (log ohm/sq) Comp. 3 | SER (log ohm/sq) Control |
|---|---|---|---|---|
| 0.88 | 11.2 | 12.4 | 13.5 | 14 |
| 0.99 | 12.1 | 11.8 | 13.7 | 14 |
| 1.41 | 14 | 14 | 14 | 14 |
| 1.58 | 14 | 14 | 14 | 13.2 |
| 1.62 | 12.9 | 11.2 | 12.9 | 13.5 |
| 1.72 | 9.8 | 11.1 | 13.4 | 14 |
| 1.72 | 12.9 | 11.2 | 13.6 | 14 |
| 1.88 | 9.4 | 10.5 | 12.8 | 13.9 |
| 1.98 | 7.5 | 9.1 | 12.2 | 13.9 |
| 2.17 | 8.6 | 9.8 | 12.4 | 13.9 |
| 2.75 | 7.4 | 8.4 | 11.4 | 14 |
| 3.3 | 7 | 7 | 10.1 | 14 |
| 3.52 | 8.3 | 9.8 | 11.3 | 14 |
| 3.6 | 7.5 | 7.4 | 9 | 14 |
| 4.03 | 7 | 7.7 | 12.1 | 13.4 |
| 4.95 | 7.8 | 7 | 8.6 | 14 |
| 6.05 | 7.2 | 7 | 10.1 | 13.9 |

As hereinabove-described, the imaging elements of this invention incorporate an electrically-conductive layer and this layer is formed using metallo-organic decomposition (MOD) precursor thin films to generate a layer with an appropriate level of electrical conductivity as a result of a glow discharge treatment (GDT). The process is based on the GDT-induced transformation of the MOD thin film coated on a suitable substrate. Use of a metallo-organic compound in combination with a glow discharge treatment provides a controlled degree of electrical conductivity. It also serves to produce a layer with beneficial chemical, physical and optical properties which adapt it for such purposes as providing protection against static or serving as an electrode which takes part in an image-forming process. The glow discharge process functions to generate the electrically-conductive layer without any need for application of high temperatures and with little or no degradation of support materials and is accordingly particularly useful for the manufacture of photographic elements.

The invention has been described in detail, with particular reference to certain preferred embodiments thereof, but it should be understood that variations and modifications can be effected within the spirit and scope of the invention.

We claim:

1. A method for the manufacture of an electrically-conductive material that is useful as a base for a photographic element; said method comprising the steps of:

(1) providing a polymeric support;

(2) forming a coating composition comprising a metallo-organic compound and a film-forming binder;

(3) coating a non-conductive layer of said coating composition on the surface of said support; and (4) subjecting said non-conductive layer to glow discharge treatment in an oxygen containing atmosphere for a period of time of from 0.3 seconds to 15 seconds wherein the metallo-organic compound is decomposed and the layer is rendered electrically-conductive.

2. A method as claimed in claim 1, wherein said metallo-organic compound is a compound of a metal selected from groups II, III, IV, V or VI of the periodic table of the elements.

3. A method as claimed in claim 1, wherein said support is a polyethylene terephthalate film.

4. A method as claimed in claim 1, wherein said coating composition comprises a weight ratio of metallo-organic compound to film-forming binder of at least about two to one.

5. A method as claimed in claim 1, wherein said glow discharge treatment provides an energy input to said layer of at least about three Joules per square centimeter.

6. A method as claimed in claim 1, wherein said coating composition comprises a tin carboxylate, an antimony alkoxide and a film-forming polymeric binder.

7. A method as claimed in claim 1, wherein said coating composition comprises tin 2-ethylhexanoate, antimony tributoxide, polyvinyl butyral and butanol.

8. A method for manufacture of a photographic element which comprises a polymeric support, a silver halide emulsion layer and an electrically-conductive layer; said method comprising the steps of:

(1) providing a polymeric support;

(2) forming a coating composition comprising a metallo-organic compound and a film-forming binder;

(3) coating a non-conductive layer of said coating composition on a surface of said support;

(4) drying said non-conductive layer of said coating composition;

(5) subjecting said dried layer of said coating composition to glow discharge treatment in an oxygen containing atmosphere for a period of time of from 0.3 seconds to 15 seconds wherein the metallo-organic compound is decomposed and said dried layer is rendered electrically-conductive;

(6) forming a silver halide emulsion coating composition;

(7) coating a layer of said silver halide emulsion coating composition superposed on said dried layer to provide said silver halide emulsion layer; and (8) drying said silver halide emulsion layer.

* * * * *